US007390344B2

(12) United States Patent
Kobayashi

(10) Patent No.: US 7,390,344 B2
(45) Date of Patent: Jun. 24, 2008

(54) METAL GRAPHITE MATERIAL AND PRODUCTION METHOD THEREOF

(75) Inventor: Hiroshi Kobayashi, Kariya (JP)

(73) Assignee: Aisin Seiki Kabushiki Kaisha, Kariya-shi (JP)

( * ) Notice: Subject to any disclaimer, the term of this patent is extended or adjusted under 35 U.S.C. 154(b) by 664 days.

(21) Appl. No.: 10/870,178

(22) Filed: Jun. 18, 2004

(65) Prior Publication Data

US 2004/0255720 A1 Dec. 23, 2004

(30) Foreign Application Priority Data

Jun. 20, 2003 (JP) ..... 2003-176054

(51) Int. Cl.
*B22F 3/00* (2006.01)
*H01B 1/16* (2006.01)

(52) U.S. Cl. ..... 75/247; 75/243

(58) Field of Classification Search ..... 75/243, 75/247; 427/113, 114, 123
See application file for complete search history.

(56) References Cited

U.S. PATENT DOCUMENTS

| | | | | |
|---|---|---|---|---|
| 4,240,830 | A * | 12/1980 | Lee | 419/28 |
| 4,799,957 | A * | 1/1989 | Vogel | 75/243 |
| 5,134,039 | A * | 7/1992 | Alexander et al. | 428/614 |
| 5,965,297 | A * | 10/1999 | Fanteux et al. | 429/231.8 |
| 6,398,936 | B1 * | 6/2002 | Lin et al. | 205/85 |
| 2003/0138698 | A1 * | 7/2003 | Lee et al. | 429/231.8 |
| 2004/0255720 | A1 | 12/2004 | Kobayashi | |

FOREIGN PATENT DOCUMENTS

| | | |
|---|---|---|
| GB | 1 438 224 | 6/1976 |
| JP | 3-88291 | 4/1991 |
| JP | 5-144534 | 6/1993 |
| JP | 6-303742 | 10/1994 |
| JP | 6-320106 | 11/1994 |
| JP | 2641695 | 5/1997 |
| JP | 2003-134740 | 5/2003 |
| WO | WO 00/36169 | 6/2000 |

OTHER PUBLICATIONS

U.S. Appl. No. 11/477,455, filed Jun. 30, 2006, Kobayashi.
U.S. Appl. No. 11/547,505, filed Oct. 2, 2006, Kobayashi.

* cited by examiner

*Primary Examiner*—Roy King
*Assistant Examiner*—Ngoclan T. Mai
(74) *Attorney, Agent, or Firm*—Oblon, Spivak, McClelland, Maier & Neustadt, P.C.

(57) ABSTRACT

Metal graphite material including a molded body having a collectivity of graphite particles and copper particles comprises graphite and copper as main elements, the copper particles including copper microparticles where each copper microparticle having average diameter between 5 and 100 nm contacts, and a cluster of the copper microparticles fixed on a surface of the graphite particle to form a conductive path of the contacting copper microparticles on the surface of the graphite particle, wherein a charge induced from the graphite particle is conducted, and a method for making metal graphite material comprises the steps of: applying a solution including metal complex whose main element is copper on a surface of a graphite particle and forming a coating film of the solution on the surface of the graphite particle, and calcinating a molded body of a collectivity of the graphite particles on which the coating films are formed under an oxygen including atmosphere, and heating the molded body under a deoxidizing atmosphere.

2 Claims, 3 Drawing Sheets

Process 1 for forming capsule of copper microparticle on surface of graphite particle Process 2 for forming capsule of copper microparticle on surface of graphite particle

METAL GRAPHITE MATERIAL AND PRODUCTION METHOD THEREOF

This application is based on and claims priority under 35 U.S.C. § 119 with respect to 2003-176054 filed on Jun. 20, 2003, the entire contents of which are incorporated herein by reference.

FIELD OF THE INVENTION

The current invention relates to metal graphite material whose main elements are graphite particle and electrolytic copper powder and a production method thereof. More specifically, the invention is applicable to, for example, a metal graphite brush used at a conductive path of a motor and the like.

BACKGROUND OF THE INVENTION

Known arts are related to a metal graphite brush, especially the known arts are related to improvement of a life of the metal graphite brush. A first known art disclosed in Japanese Patent No.2641695 relates to a production method of a metal graphite brush, especially, a production method of a metal graphite brush using a specific graphite bond at a specific amount to enhance a binding strength of the metal graphite and decrease a friction coefficient of the metal graphite.

In the first known art, the bond of the brush is prepared by mixing novolak type phenol resin with furfural resin at a specific ratio. Such bond is mixed with the metal graphite and calcinated, and the bond evenly included in the metal graphite is carbonized to become non-crystalloid carbon (generally known as soot). On this account, binding strength between each graphite particle can be improved, which has the same effect as abrasion proof material for adjusting a film on the surface of the brush. Using such material, the film having lubricating property reduces friction resistance of the brush, as a result, abrasion life of the brush can be extended.

A second known art disclosed in Japanese patent Laid-open Publication No. H05(1993)-144534 is also relates to a production method of the metal graphite brush, wherein copper powders of the brush include microparticles and large particles at a certain compounding ratio for reducing the wear of the brush by preventing sliding noise of the brush sliding on a commutator and heat generated by the friction.

Specifically, in the second know art, the copper powder having a large particle diameter reduces a contact resistance of the brush against the commutator. As a result, the heating value is reduced, and the abrasion life is improved.

As aforementioned above, each known art uses different means for improving the abrasion life of the brush. Specifically, the first known art uses the film having lubricating property, which is made by applying and calcinating the mixture of the novolak type phenol resin and the furfural resin. In the second known art, on the other hand, the brush includes two different kinds of copper powders having different diameter for reducing the contact resistance between the copper powder having large particle diameter and the commutator.

SUMMARY OF THE INVENTION

According to an aspect of the present invention, metal graphite material including a molded body having a collectivity of graphite particles and copper particles comprises graphite and copper as main elements, the copper particles including copper microparticles where each copper microparticle having average diameter between 5 and 100 nm contacts, and a cluster of the copper microparticles fixed on a surface of the graphite particle to form a conductive path of the contacting copper microparticles on the surface of the graphite particle, wherein a charge induced from the graphite particle is conducted.

According to another aspect of the present invention, a method for making metal graphite material comprises the steps of: applying a solution including metal complex whose main element is copper on a surface of a graphite particle and forming a coating film of the solution on the surface of the graphite particle, and calcinating a molded body of a collectivity of the graphite particles on which the coating films are formed under an oxygen including atmosphere, and heating the molded body under a deoxidizing atmosphere.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

An embodiment applied to a metal graphite brush used at a motor as typical metal graphite material will be explained as follows. In the embodiment, basic materials of the metal graphite brush are same as the known brushes; however, a structure of material of the metal graphite brush is different. Specifically, in the embodiment, copper microparticles whose diameter is average 5-100 nanometer is formed on graphite particle as a continuing path of copper for conducting and emitting a charge. The graphite particle on which the copper microparticles are fixed is larger than the copper microparticles. The size of the graphite particle is, for example, 10-200 μm, especially 30-100 μm; however, the size is not limited to such value.

Further preferred embodiments of the current invention includes a means for forming the copper microparticles on a surface of the graphite particle, wherein a solution of carboxylic acid copper (metal complex whose main element is copper) is mixed with a binder solution such as a solution of denatured phenol resin which generates non-crystalloid carbon by oxidative reaction to prepare a solution including metal complex whose main elements are copper and a binder, then the mixed solution is applied on the surface of the graphite particle to form a coating film.

Usage of the binder will be explained as follows. There are two different kinds of binders. One binder has two functions; forming the coating film of the carboxylic acid copper solution on the surface of the graphite particle, and combining each graphite particle by non-crystalloid carbon generated when graphite particle having the coating film of the carboxylic acid copper is oxidized. In such case, it is preferable to use a solution of the denatured phenol resin as a binder.

The other binder has only one function; forming the coating film of the carboxylic acid copper solution on the surface of the graphite particle. In such case, it is preferable to use glycerin or glycerin derivative as a binder. When such chemicals are used as a binder, the glycerin or the glycerin derivative is added to the carboxylic acid copper solution as a binder to give a predetermined viscosity to the carboxylic acid copper solution, so that the coating film of the carboxylic acid copper solution is formed on the surface of the graphite particle. Such binder prevents the generation of the non-crystalloid carbon which is used to combine the graphite particles, so that it is preferable to form the coating film of the solution of the denatured phenol resin on the surface of the graphite particle after the coating film of the solution of the carboxylic acid copper is formed on the surface of the graphite particle.

Figure 3:
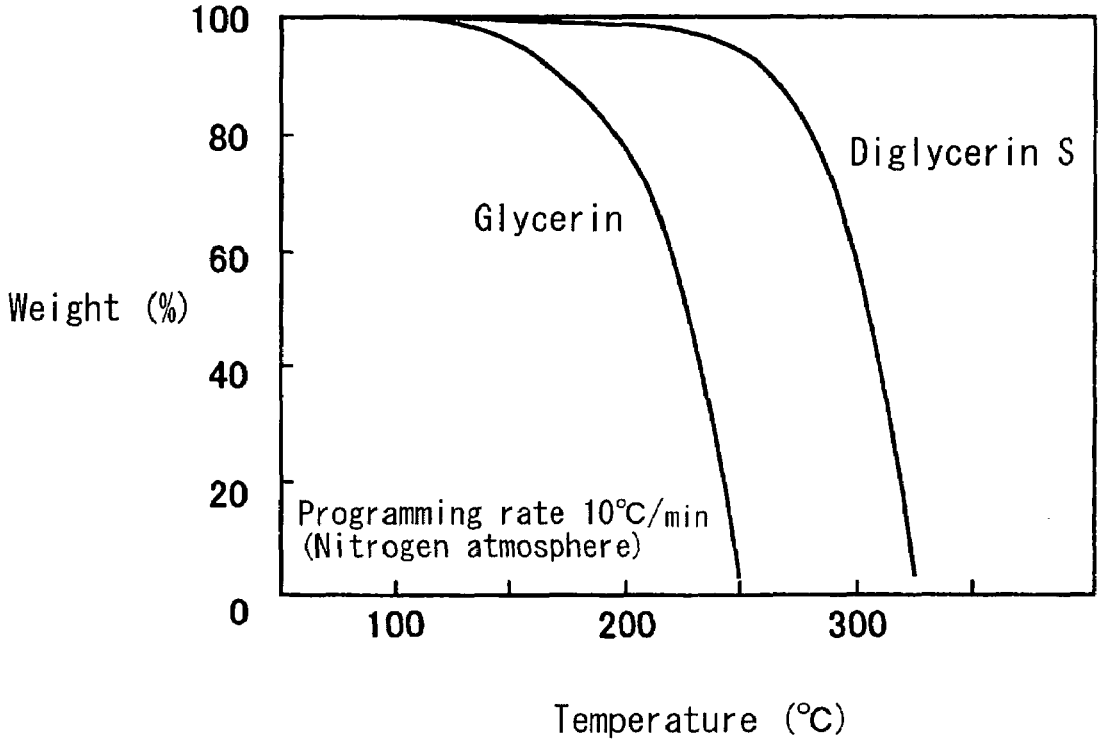
FIG. 3 illustrates a graph indicating a relationship between temperature and weigh of glycerin and diglycerin.

In addition, it is preferable that the aforementioned chemicals having only a function as a binder is thermally decomposed in carbon dioxide and water when the molded body of the graphite particles is calcinated at 250-350° C. temperature, then such carbon dioxide and water evaporates into the air, in other word, no residue remains due to the thermal decomposition reaction. In such point of view, it is considered that glycerin and diglycerin as glycerin derivative being thermally decomposed at below 350° C. and having a predetermined viscosity are preferable chemicals. Viscosity of the glycerin is 1500 mPa·s at 20° C., and the thermal decomposition starts at 150° C. and finishes at 250° C. (shown in FIG. 3). Viscosity of the diglycerin is 120 mPa·s at 20° C., and the thermal decomposition starts at 250° C. and finishes at 320° C. (shown in FIG. 3). In response to an appropriate thickness of the coating film, glycerin or diglycerin can be diluted with methanol and mixed into the solution of carboxylic acid copper. FIG. 3 indicates relationships between temperature and weight of glycerin and diglycerin. Structure 1 indicates a molecular structure of glycerin, and structure 2 indicates a molecular structure of diglycerin.

[Structure 1]

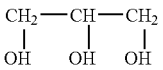

molecular structure of glycerin

[Structure 2]

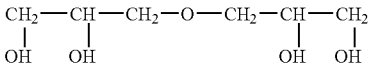

molecular structure of diglycerin

Further, as aforementioned before, the molded body of the collectivity of the graphite particles on which the coating films are formed are calcinated under the oxygen including atmosphere. Then, the molded body is heated under the deoxidizing atmosphere, as a result, the metal graphite material according claim 1 is made. The carboxylic acid copper becomes nano-level copper microparticles, and such particle is precipitated on the surface of the graphite particle. Basically, other elements evaporate into the air after decomposed into carbon dioxide and water.

Furthermore, in the embodiment, the precipitated copper microparticles is formed as small as possible, and such copper microparticles are precipitated on the surface of the graphite particle at high density. As a result, neighboring copper microparticles contact each other, and a conductive path can be made by such contacting copper microparticles on the surface of the graphite particle. Further, the copper microparticles precipitated on the surface of the graphite particle is fixed on the surface of the graphite with the non-crystalloid carbon as a binder obtained by carbonizing a binder such as the denatured phenol resin.

Figure 1:
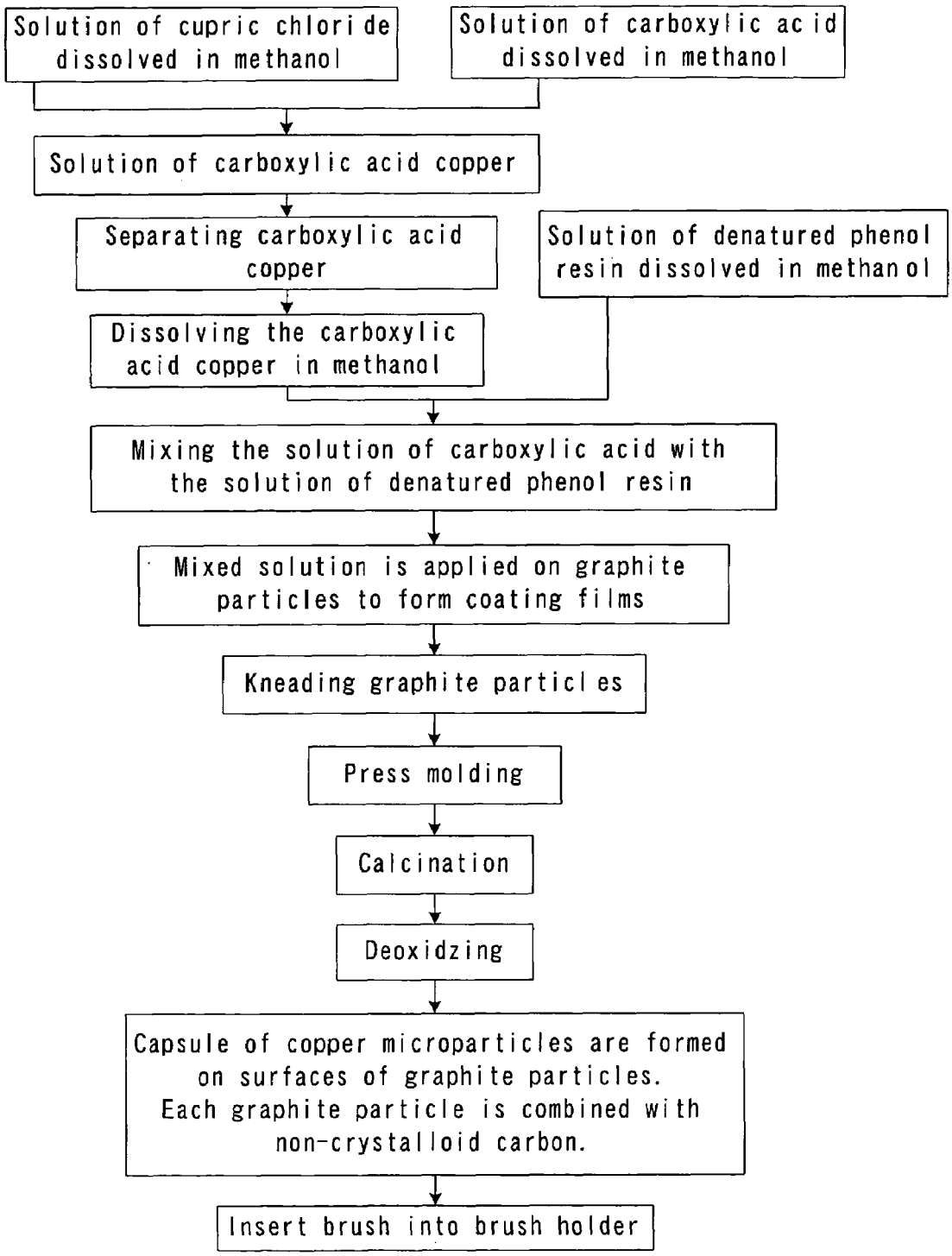
FIG. 1 illustrates a diagram of a process for forming copper microparticles on a graphite particle.

FIG. 1 illustrates a typical process for forming the metal graphite brush. (generating the carboxylic acid copper)

According to the typical process shown in FIG. 1, a solution of the carboxylic acid copper being metal complex including copper as a main element is prepared at first. The solution of the carboxylic acid copper is made by liquid-phase reaction between a solution of the copper chloride and a solution of the carboxylic acid. A preferable copper compound being one material of the carboxylic acid copper is copper chloride, copper sulfate, copper nitrate, copper carbonate or the like. Considering the solubility in each solvent shown in Table 1, it is preferable to use the copper chloride, especially cupric chloride. To generate the carboxylic acid copper efficiently, it is preferable to generate the carboxylic acid copper of high concentration by reacting the saturated solution of the copper chloride and the saturated solution of the carboxylic acid. Further, it is preferable that the solution of the copper chloride is compatible with the solution of the carboxylic acid.

Solubility of the copper chloride in each solvent and solubility of each carboxylic acid in each solvent will be explained as follows. Table 1 indicates solubility of the cupric chloride in each solvent. The solubility of the cupric chloride is getting higher in order of the table. According to the embodiment, a saturated solution of the cupric chloride using these solvents is prepared to generate carboxylic acid copper.

TABLE 1

Solubility of copper chloride

| solvent | Solubility |
|---|---|
| water | 42.3 g dissolved in saturated solution 100 g at 20° C. |
| methanol | 37 g dissolved in saturated solution 100 g at 20° C. |
| 1-propanol | 19.7 g dissolved in saturated solution 100 g at 20° C. |
| 1-butanol | 15.4 g dissolved in saturated solution 100 g at 20° C. |

TABLE 2

Solubilities of each carboxylic acid in water

| carboxylic acid | | solubility |
|---|---|---|
| straight-chain saturated monocarboxyl acid | formic acid | Dissolved at arbitrary ratio in water. |
| | acetic acid | Dissolved at arbitrary ratio in water |
| | propionic acid | Dissolved at arbitrary ratio in water |
| | butanoic acid | 42.5 g is dissolved in saturated solution 100 cc at 20° C. |
| straight-chain saturated dicarboxyl acid | oxalic acid | 8.69 g is dissolved in saturated solution 100 g. |
| | malonic acid | 63 g is dissolved in saturated solution 100 g at 30° C. |
| | glutaric acid | 63 g is dissolved in saturated solution 100 g at 30° C. |
| | d and l dihydroxysuccinic acid | 156 g is dissolved in water 100 g at 30° C. |
| chain saturated monocarboxyl acid | lactic acid | 20 wt % dissolved at 20° C. |
| | acetoacetic acid | 20 wt % dissolved at 20° C. |
| chain unsaturated monocarboxylic acid | acrylic acids | Dissolved at arbitrary ratio in water |
| | methacrylic acid | Dissolved at arbitrary ratio relative to water |
| | levulinic acid | 20 wt % dissolved at 20° C. |
| chain unsaturated dicarboxyl acid | maleic acid | 88 g is dissolved in water 100 g at 30° C. |
| | allylic malonic acid | 20 wt % dissolved at 20° C. |

TABLE 2-continued

| Solubilities of each carboxylic acid in water | | |
|---|---|---|
| carboxylic acid | | solubility |
| aromatic series carboxylic acid | dl mandelic acid | 37.5 g is dissolved in water 100 g at 30° C. |
| | mellophanic acid | 20 wt % dissolved at 20° C. |
| others | citric acid | 67.7 g is dissolved in water 100 g at 30° C. |

TABLE 3

| Solubility of each carboxylic acid in methanol | | |
|---|---|---|
| carboxylic acid | | solubility |
| straight-chain saturated monocarboxylic acid | propionic acid | 20 wt % dissolved at 20° C. |
| | butanoic acid | Dissolved at arbitrary ratio in methanol |
| | octanoic acid | 13000 g is dissolved in methanol 100 g at 10° C. |
| | decanoic acid | 510 g is dissolved in methanol 100 g at 20° C. |
| | dodecanoic acid | 120 g is dissolved in methanol 100 g at 20° C. |
| straight-chain saturated dicarboxyl acid | glutaric acid | 20 wt % dissolved at 20° C. |
| | adipic acid | 20 wt % dissolved at 20° C. |
| | pimelic acid | 20 wt % dissolved at 20° C. |
| | suberic acid | 20 wt % dissolved at 20° C. |
| | azelaic acid | 20 wt % dissolved at 20° C. |
| chain saturated monocarboxylic acid | lactic acid | 20 wt % dissolved at 20° C. |
| | acetoacetic acid | 20 wt % dissolved at 20° C. |
| chain unsaturated monocarboxylic acid | acrylic acids | Dissolved at arbitrary ratio in methanol |
| | levulinic acid | 20 wt % dissolved at 20° C. |
| chain unsaturated dicarboxyl acid | maleic acid | 70 g is dissolved in methanol 100 g at 30° C. |
| | allylic malonic acid | 20 wt % dissolved at 20° C. |
| aromatic series monocarboxylic acid | 0-toluic acid | 20 wt % dissolved at 20° C. |
| | anisic acid | 20 wt % dissolved at 20° C. |
| | trimesic acid | 20 wt % dissolved at 20° C. |
| aromatic series dicarboxyl acid | phthalic acid | Max 16.4 g is dissolved in methanol 100 g. |
| | isophthalic acid | Max 1.7 g is dissolved in methanol 100 g. |
| | terephthalic acid | Max 16.9 g is dissolved in methanol 100 g. |

TABLE 4

| Solubility of each carboxylic acid in 1-butanol | | |
|---|---|---|
| carboxylic acid | | solubility |
| straight-chain saturated monocarboxylic acid | octanoic acid | 750 g is dissolved in solvent 100 g at 10° C. |
| | decanoic acid | 280 g is dissolved in solvent 100 g at 20° C. |
| | dodecanoic acid | 83 g is dissolved in solvent 100 g at 20° C. |
| | myristic acid | 28.7 g is dissolved in solvent 100 g at 20° C. |
| | palmitic acid | 10.5 g is dissolved in solvent 100 g at 20° C. |
| | hexadecane acid | 50 g is dissolved in solvent 100 g at 15° C. |
| chain saturated monocarboxylic acid | lactic acid | 20 wt % dissolved at 20° C. |

Examples of the carboxylic acid are shown in Table 2. The carboxylic acid includes straight-chain saturated monocarboxylic acid such as formic acid, acetic acid, propionic acid and butanoic acid; straight-chain saturated dicarboxyl acid such as oxalic acid, malonic acid and glutaric acid; chain saturated monocarboxylic acid such as lactic acid and acetoacetic acid; chain unsaturated monocarboxylic acid such as acrylic acids, methacrylic acid and levulinic acid; chain unsaturated dicarboxyl acid such as maleic acid and allylic malonic acid, or aromatic series carboxylic acid such as dl mandelic acid, mellophanic acid. At least one of aforementioned carboxylic acids can be used.

The Table 2 shows solubility of carboxylic acid in water. As shown in Table 2, solubilities of carboxylic acid such as formic acid, acetic acid, propionic acid, acrylic acids, methacrylic acid, dihydroxysuccinic acid, maleic acid, citric acid, malonic acid, glutaric acid and butanoic acid are high, and the solubilities in water is getting higher in that order. The carboxylic acid copper is generated by reacting the aqueous liquor of the carboxylic acid and the aqueous liquor of cupric chloride. It is preferable to consider that the formic acid and acetic acid have high acidity.

The Table 3 shows solubility of carboxylic acid in methanol. As shown in Table 3, solubilities of carboxylic acid such as butanoic acid, acrylic acids, octanoic acid, decanoic acid, dodecanoic acid, maleic acid are high, and the solubilities in methanol is getting higher in that order. The carboxylic acid copper is generated by reacting methanol solution of the cupric chloride with the methanol solution of the copper chloride.

The Table 4 shows solubility of carboxylic acid in 1-butanol. As shown in Table 4, solubilities of carboxylic acid such as octanoic acid, dodecanoic acid and hexadecane acid are high, and the solubilities in 1-butanol is getting higher in that order. The carboxylic acid copper is generated by reacting 1-butanol solution of the carboxylic acid with the 1-butanol solution of the cupric chloride.

TABLE 5

| Solubility of each carboxylic acid in 1-propanol | | |
|---|---|---|
| carboxylic acid | | solubility |
| aromatic series monocarboxylic acid | salicylic acid | 22.3 g is dissolved in saturated solution 100 cc at 20° C. |
| aromatic series dicarboxyl acid | phthalic acid | 4.3 g is dissolved in saturated solution 100 cc at 20° C. |
| | terephthalic acid | 4.4 g is dissolved in saturated solution 100 cc at 20° C. |

TABLE 6

| Example of generating of carboxylic acid copper | | |
|---|---|---|
| Example | Solution of cupric chloride | Solution of carboxylic acid |
| 1 | saturated aqueous solution | saturated aqueous solution of propionic acid, acrylic acids and methacrylic acid |
| 2 | saturated aqueous solution | saturated aqueous solution of dihydroxysuccinic acid, maleic acid, malonic acid and glutaric acid |
| 3 | saturated methanol solution | saturated methanol solution of butanoic acid, acrylic acids and octanoic acid |
| 4 | saturated methanol solution | saturated methanol solution of dodecanoic acid and maleic acid |
| 5 | saturated 1-butanol solution | saturated 1-butanol solution of octanoic acid, decanoic acid and dodecanoic acid |
| 6 | saturated 1-propanol solution | saturated 1-propanol solution of salicylic acid |

TABLE 7

Examples of solutions of each carboxylic acid copper

| Example | solvent | carboxylic acid copper |
|---|---|---|
| 7 | methanol | butanoic acid copper |
| 8 | methanol | acrylic acids copper |
| 9 | methanol | octanoic acid copper |
| 10 | methanol | decanoic acid copper |
| 11 | methanol | Lauric acid copper |
| 12 | 1-butanol | octanoic acid copper |
| 13 | 1-butanol | decanoic acid copper |
| 14 | 1-butanol | dodecanoic acid copper |
| 15 | 1-butanol | hexadecane acid copper |

TABLE 8

Examples of each mixed solution

| Example | Solution of carboxylic acid copper | Solution of phenol resin | mixing ratio, volume ratio |
|---|---|---|---|
| 17 | methanol solution of butanoic acid copper | Methanol solution | 1:1 |
| 18 | methanol solution of acrylic acids copper | Methanol solution | 1:1 |
| 19 | methanol solution of octanoic acid copper | Methanol solution | 2:1 |
| 20 | methanol solution of decanoic acid copper | Methanol solution | 4:1 |
| 21 | methanol solution of dodecanoic acid copper | methanol solution | 8:1 |
| 22 | 1-butanol solution of octanoic acid copper | 1-butanol solution | 6:1 |
| 23 | 1-butanol solution of decanoic acid copper | 1-butanol solution | 15:1 |
| 24 | 1-butanol solution of dodecanoic acid copper | 1-butanol solution | 50:1 |

The Table 5 shows solubility of carboxylic acid in 1-propanol. As shown in Table 5, solubility of carboxylic acid such as salicylic acid is high. The carboxylic acid copper is generated by reacting 1-propanol solution of the salicylic acid with the 1-propanol solution of the cupric chloride.

Considering the solubility of the cupric chloride and each carboxylic acid relative to each solvent, typical examples, examples 1-6, are shown in Table 6 by which high concentrated carboxylic acid copper can be generated. As shown in Table 6, in the example 1, the carboxylic acid copper is generated by reacting the saturated aqueous liquor of the cupric chloride and saturated aqueous liquor of the propionic acid or acrylic acids. In the example 2, the carboxylic acid copper is generated by reacting the saturated aqueous liquor of the cupric chloride with the saturated aqueous liquor of the dihydroxysuccinic acid, maleic acid, malonic acid or glutaric acid. In the example 3, the carboxylic acid copper is generated by reacting the saturated methanol solution of the cupric chloride with the saturated methanol solution of the butanoic acid, acrylic acids, octanoic acid or decanoic acid.

In the example 4, the carboxylic acid copper is generated by reacting the saturated methanol solution of the cupric chloride with the saturated methanol solution of the dodecanoic acid or maleic acid.

In the example 5, the carboxylic acid copper is generated by reacting the saturated 1-butanol solution of the cupric chloride with the saturated 1-butanol solution of the octanoic acid, decanoic acid, dodecanoic acid or hexadecane acid. In the example 6, the carboxylic acid copper is generated by reacting the saturated 1-propanol solution of the cupric chloride with the saturated 1-propanol solution of the salicylic acid.

Then, the carboxylic acid copper is extracted by separating the solvent from the carboxylic acid copper solution including the carboxylic acid copper generated in above examples 1-6. Then, the solution of the carboxylic acid copper is prepared by dissolving the precipitated carboxylic acid copper in organic solvent. The solution of the carboxylic acid copper will be mixed into the solution of the phenol resin, or a diluted solution of the glycerin or the glycerin derivative, so that it is preferable that the solution of the carboxylic acid copper has a property being compatible with the solution the solution of the phenol resin (binder solution), or a diluted solution of the glycerin or the glycerin derivative. A functional group of phenol resin is high polarity, so that the phenol resin dissolves in the organic solvent such as polar alcohol group, ketone group, or the glycerin or the glycerin derivative. Thus, it is preferable that the carboxylic acid copper is dissolved in the organic solvent in which the carboxylic acid copper can dissolve and being compatible with the solution of the phenol resin or diluted solution of the glycerin or the glycerin derivative. Denatured phenol resin can be used as phenol resin.

At least one of methanol, ethanol, 1-propanol, 1-butanol, ethylene glycol or glycerin can be used as an alcohol for dissolving the phenol resin functioning as a binder. Acetone can be used as ketone for dissolving the phenol resin functioning as a binder. It is preferable that these organic solvent can dissolve the phenol resin, at the same time can dissolve carboxylic acid copper itself The carboxylic acid copper indicated in examples 1-6 has a low solubility relative to another solvents which is not used for generating such carboxylic acid copper. Thus, at least either one of methanol, 1-butanol or 1-propanol can be used as the organic solvent for dissolving the carboxylic acid copper and the phenol resin.

Furthermore, the solution of the carboxylic acid copper is applied on the surface of the graphite particle as a coating film, and a molded body formed with such graphite particles including the coating films is calcinated under the oxygen including atmosphere. At this point, the solution of the carboxylic acid copper is thermally decomposed in carbon dioxide, water and copper, then the carbon dioxide and water evaporate into the air, as a result, only copper is precipitated. Then the precipitated copper particle is oxidized to become copper oxide and precipitated on the surface of the graphite particle. Furthermore, the microparticles of the copper oxide becomes copper microparticles by heating the molded body under the deoxidizing atmosphere. It is preferable that a density of the precipitated copper microparticles is high because each neighboring copper microparticles can electrically contacts, and the electrically continuing conductive path can be made by such contacting copper microparticles on the surface of the graphite particle. Thus, it is preferable that the solubility of the solution of the carboxylic acid copper is high.

Thus, a solution of carboxylic acid copper is made by dissolving carboxylic acid copper in organic solvent such as methanol or 1-butanol. Examples 7-15 in Table 7 indicate organic solvents in which carboxylic acid copper is dissolved. As shown in Table 7, examples 7-11 show examples of methanol solutions in which metal complex having relatively high solubility of carboxylic acid copper is dissolved, and examples 12-15 show examples of 1-butanol solutions in which metal complex having relatively high solubility of carboxylic acid copper is dissolved.

Solution of denatured phenol resin includes a solution of denatured phenol resin as a binder which is dissolved in methanol or 1-butanol (shown in Table 8).

Then, the aforementioned solution of carboxylic acid copper is mixed with the aforementioned solution of denatured phenol resin (binder solution). Viscosity of such mixed solution will be set appropriately, for example, 10-200 mPa·s. Such mixed solution whose viscosity has been adjusted is applied on a surface of the graphite particle by means of spraying or dipping, thus a coating film of the mixed solution is formed on the surface of the graphite particle. It is preferable to adjust the viscosity of the mixed solution to be 10-200 mPa·s, especially 80 mPa·s in advance for forming a thin coating film (1 nm) of the mixed solution on the surface of the graphite particle. Methanol or 1-butanol can be applied to adjust the viscosity of the mixed solution. Alcohol-like elements in the solvent will evaporate into the air before the denatured phenol resin is carbonized.

Examples 17-24 in Table 8 shows mixed solutions of the aforementioned solution of the carboxylic acid copper and the solution of denatured phenol resin (binder solution). Mixing ratios in Table 8 indicate volume percentages of the carboxylic acid copper solution:the denatured phenol resin solution.

As aforementioned before, the coating film of the mixed solution is formed on the surface of the graphite particle. Then the graphite particles are kneaded and collected to form a molded body. Such molded body is calcinated under an oxygen including atmosphere. Furthermore, the molded body is heated under a deoxidizing atmosphere. In this way, the metal graphite material is made.

Referring to the process shown in FIG. 1, a solution of metal complex where the main element is copper used for forming the coating film on the surface of the graphite particle is prepared through the following processes. First, a solution including carboxylic acid copper is made by mixing a solution including carboxylic acid copper with a solution including at least one of copper chloride, copper sulfate, copper nitrate or copper carbonate. Second, the solution including carboxylic acid copper is made by mixing a binder solution including a binder with a solution where the carboxylic acid copper dissociated from the carboxylic acid copper solution is dissolved in a solvent. This mixed solution is applied on the surface of the graphite particle as a coating film by means of dipping or spraying.

Results related to examples 17-24 shown in Table 8 when the copper microparticles is formed through aforementioned process are explained as follows. The example 17, 18 and 19 represent the highest solubility of the carboxylic acid copper dissolved in the methanol solution. The example 17 uses butanoic acid copper as carboxylic acid copper. The example 18 uses acrylic acids copper as carboxylic acid copper. The example 19 uses octanoic acid copper as carboxylic acid copper. Butanoic acid is straight-chain saturated monocarboxylic acid whose molecular formula is CH3(CH2)2COOH. Octanoic acid is straight-chain saturated monocarboxylic acid whose molecular formula is CH3(CH2)6COOH. Acrylic acids is chain unsaturated monocarboxylic acid whose molecular formula is CH2═CHCOOH.

The size of the copper microparticles precipitated on the surface of the graphite particle when the butanoic acid copper or the octanoic acid copper is used in the process is far smaller than the size of the copper microparticles precipitated on the surface of the graphite particle when the acrylic acids copper is used in the process. The density of the copper microparticles precipitated on the surface of the graphite particle when the butanoic acid copper or the octanoic acid copper is used in the process is higher than the density of the copper microparticles precipitated on the surface of the graphite particle when acrylic acids copper is used in the process. When the acrylic acids copper is used in the process, rather larger copper microparticles are precipitated and dispersed on the surface of the graphite particle, so that it is difficult to obtain the copper microparticles having a preferable film structure when the acrylic acids copper is used in the process even if the solubility of the carboxylic acid copper in the methanol solution is high. Thus, the butanoic acid copper or the octanoic acid copper is preferably used in the process as carboxylic acid copper than the acrylic acids copper. Furthermore, the size of the precipitated copper particle using the octanoic acid copper is smaller than the size of the precipitated copper particle using the butanoic acid copper, and the density of the precipitated copper microparticles using the octanoic acid copper is higher than the density of the precipitated copper microparticles using the butanoic acid copper. Thus, it is preferable to uses the octanoic acid copper as carboxylic acid copper in the process.

The examples 20 and 21 represent the relatively higher solubility of the carboxylic acid copper in the methanol solution. The example 20 uses decanoic acid copper as carboxylic acid copper. The example 21 uses dodecanoic acid copper as carboxylic acid copper. Decanoic acids is straight-chain saturated monocarboxylic acid whose molecular formula is CH3(CH2)8COOH. Dodecanoic acids is straight-chain saturated monocarboxylic acid whose molecular formula is CH3(CH2)10COOH. The size of the copper microparticles precipitated on the surface of the graphite particle when the decanoic acid copper is used in the process is smaller than the size of the copper microparticles precipitated on the surface of the graphite particle when the dodecanoic acid copper is used in the process. The density of the copper microparticles precipitated on the surface of the graphite particle when the decanoic acid copper is used in the process is higher than the density of the copper microparticles precipitated on the surface of the graphite particle when the dodecanoic acid copper is used in the process. Even if the solubility of the decanoic acid copper and the dodecanoic acid copper in the methanol is lower than the solubility of the butanoic acid copper, the size of the precipitated copper microparticles of the decanoic acid copper and the dodecanoic acid copper is smaller than the size of the precipitated copper microparticles of the butanoic acid copper, and the density of the decanoic acid copper and the dodecanoic acid copper is higher than the density of the butanoic acid copper. Even if the copper microparticles precipitated from the butanoic acid copper is used, the copper film formed on the surface of the graphite particle is functional. The size of the copper microparticles precipitated from the decanoic acid copper is smaller than the size of the copper microparticles precipitated from the octanoic acid copper, and the copper microparticles precipitated from the dodecanoic acid copper is larger than the copper microparticles precipitated from the octanoic acid copper. The density of the particles precipitated from the decanoic acid copper is similar to the density of the particles precipitated from the octanoic acid copper, and higher than the density of the particles precipitated from the dodecanoic acid copper.

Considering above results, when the copper microparticles is precipitated from such carboxylic acid copper, preferable carboxylic acid copper includes the decanoic acid copper, octanoic acid copper, dodecanoic acid copper and the butanoic acid copper, in that order, for forming the film of the copper microparticles. This result is attributable to the length of the straight-chain structure of the saturated carboxylic acid.

Next, the results of examples 22-24 using a solution of the 1-butanol are explained as follows. Each carboxylic acid coppers (octanoic acid copper, decanoic acid copper and dodecanoic acid copper) are based on saturated monocarboxylic acid being straight-chain structure. Solubility of the carboxylic acid in 1-butanol is getting lower, and the molecular mass of the carboxylic acid is getting greater in order of the number of examples. In each example, result is similar to corresponding result using the methanol solution. The size of the copper microparticles precipitated from the decanoic acid copper is slightly smaller than the size of the copper microparticles precipitated from the octanoic acid copper, and the copper microparticles precipitated from the dodecanoic acid copper is larger than the copper microparticles precipitated from the octanoic acid copper. The density of the particles precipitated from the decanoic acid copper is similar to the density of the particles precipitated from the octanoic acid copper, and higher than the density of the particles precipitated from the dodecanoic acid copper.

Above results of the same carboxylic acid copper dissolved in different solvent, the methanol and the butanol, are compared as follows. In the example 19 and the example 22, the octanoic acid copper is used as copper complex, and methanol is used in the example 19, and 1-butanol is used in the example 22 as a solvent The size of the precipitated copper microparticles from the methanol solution (the example 19) is slightly smaller than the size of the precipitated copper microparticles from the 1-butanol solution (the example 22), and the density of the precipitated copper microparticles from the methanol solution (the example 19) is higher than the density of the precipitated copper microparticles from the 1-butanol solution (the example 22). Such difference results in the difference of the solubility of the carboxylic acid coppers.

In the example 20 and the example 23, the decanoic acid copper is used as copper complex, and methanol is used in the example 20, and 1-butanol is used in the example 23 as a solvent. In the example 21 and the example 24, the dodecanoic acid copper is used as copper complex, and methanol is used in the example 20, and 1-butanol is used in the example 23 as a solvent. In each example, the density of the precipitated copper microparticles from the methanol solution is higher than the density of the precipitated copper microparticles from the 1-butanol solution, however, it is possible to precipitate practical copper microparticles from the 1-butanol solutions of these three kinds of carboxylic acid coppers as the results of examples of the octanoic acid copper.

As a summary of the above results, the size of the precipitated copper microparticles in the example 20 is similar to the size of the precipitated copper microparticles in the example 23, and both sizes are smaller than the example 19 and the example 22. The size of the precipitated copper microparticles in the example 19 is similar to the size of the precipitated copper microparticles in the example 22. The size of the precipitated copper microparticles in the example 21 is similar to the size of the precipitated copper microparticles in the example 24, and both sizes are larger than the example 19 and the example 22. Density in the example 20 is similar to the density in the example 19, and both are higher than the example 23 and the example 22. Density in the example 23 is similar to the density in the example 22, and both are higher than the example 21 and the example 24. Density in the example 21 is similar to the density in the example 24.

Thus, preferable carboxylic acid copper is decanoic acid copper, octanoic acid copper and dodecanoic acid copper, in that order, for precipitating clusters of the copper microparticles being as small as possible at high density. Using such carboxylic acid copper solutions, copper microparticles being 5-120 nanometer, 10-100 nanometer, and average 10-50 nanometer is precipitated on the surface of the graphite particle at high density, so that neighboring copper microparticles are contacting each other.

To change the current density applied to the brush, the precipitating volume of the copper including the copper microparticles can be changed. To increase the precipitating volume of the copper, the current density can be greater. To increase the precipitating volume of the copper, mixing ratio of the solution of the carboxylic acid copper relative to the solution of the phenol resin can be increased, at the same time, the amount of the solution applied to the native graphite particles can be increased.

Then, the molding and calcinating process of the graphite particles at which the coating films are formed will be explained as follows. Specifically, the graphite particles including the coating films are formed are kneaded. Then, the collectivity of the graphite particles formed by the accumulation of the copper microparticles is pressed by a pressure-molding machine to be a certain shape. In this way, the molded body is formed. Specifically, to mold the original model of the brush for the motor, the collectivity of the graphite particles is filled into a box container, and a predetermined pressure is applied to the container. In this way, a compressed molded body of the graphite particles being cuboid shape is formed. Then, such molded body is calcinated under the oxygen including atmosphere in the calcinating process. At this point, copper atom which constitutes the carboxylic acid copper being one element of the coating film formed on the surface of the graphite particle is precipitated on the surface of the graphite particle of the microparticles of the copper oxide by the calcinations. On the other hand, the denatured phenol resin which functions as a binder being the other element of the coating film formed on the surface of the graphite particle is calcinated, and some carbon atom reacting with the oxygen to be carbon dioxide evaporate into the air, and the other carbon atom is precipitated as solid material of the non-crystalloid carbon.

At this point, when the amount of the non-crystalloid carbon generated from the carbon atom which constitutes the carboxylic acid copper and the denatured phenol resin is greater than the amount of the copper oxide generated from the copper atom of the carboxylic acid copper, a new resistance layer can be made by the non-crystalloid carbon because a resistivity of the non-crystalloid carbon is higher than a resistivity of the graphite particle, and the electric resistance of the whole brush will be increased. Thus, such configuration is not preferable. In addition, this may prevent the electron which is induced when the high electric field is applied to the brush to move from the graphite particle to the cluster of the copper microparticles formed on the surface of the graphite particle. To reduce the electric resistance on the layer of the surface of the graphite particle, it is preferable that the volume ratio of the elements in the solid body precipitated by the calcinations is follows; the volume of the copper oxide particle is equal to or more than 50% of the total volume, and the volume of the non-crystalloid carbon is equal to or less than 50% of the total volume, especially, the volume of the copper oxide particle is equal to or more than 90% of the total volume, and the volume of the non-crystalloid carbon is equal to or less than 10% of the total volume. It is preferable that the carbon atom which constitutes the carboxylic acid copper and the carbon atom which constitutes the phenol resin become carbon dioxide to be evaporated. Such products are obtained under the oxygen including atmosphere such as the atmospheric environment as a calcinate atmosphere. In addition, it is preferable to use the denatured phenol resin as phenol resin because such product can be thermally decomposed at relatively low temperature.

It is preferable that all hydrogen atoms of the phenol resin and all hydrogen atoms of the carboxylic acid copper react with oxygen and become water, which finally evaporates into the air. So, the molded body is calcinated under the oxygen including atmosphere such as the atmospheric environment. Further, it is preferable that oxygen atom of the carboxylic acid copper is used for oxidizing the copper components of the copper microparticles precipitated from the copper atom of the carboxylic acid copper to make the copper oxide. So, the molded body is calcinated under the oxygen including atmosphere such as the atmospheric environment.

Next, the calcination temperature will be explained in detail. When the carboxylic acid copper is calcinated under the oxygen including atmosphere such as the atmospheric environment, generally the size of the precipitated copper oxide tends to vary depending on the calcination temperature. The current invention seeks to form the membranous conductive path of the copper microparticles for the charge on the surface of the graphite particle by precipitating and accumulating the copper microparticles on the surface of the graphite particle to be contacting each other at high frequency, so that it is preferable that the microparticles of the copper oxide being is small is precipitated at high density on the surface of the graphite particle. To precipitate the copper microparticles oxide is precipitated at high density, it is preferable that the calcination temperature is equal to or less than 500° C., especially, more than 300° C. and equal to or more than 400° C. The calcinate time being vary depending on a size of the molded body or the calcination temperature can be from 20 minutes to 4 hours, especially, from 30 minutes to 1 hour. After the calcinations, the molded body including the microparticles of the copper oxide is heated under the deoxidizing atmosphere for deoxidizing the copper oxide in the copper microparticles. The deoxidizing atmosphere can be a hydrogen including atmosphere including, for example, equal to or more than 50 Vol % nitrogen gas and equal to Or less than 50 Vol % hydrogen gas, especially, including from 90 to 95 Vol % nitrogen gas and from 5 to 10 Vol % hydrogen gas. The deoxidizing temperature can be less than the aforementioned calcination temperature, which is from 150 to 500° C., especially from 200 to 300° C., more specifically, around 250° C. The deoxidization time can be less than the calcinate time, which is from 10 minutes to 2 hours, especially from 20 minutes to 30 minutes.

Figure 2:
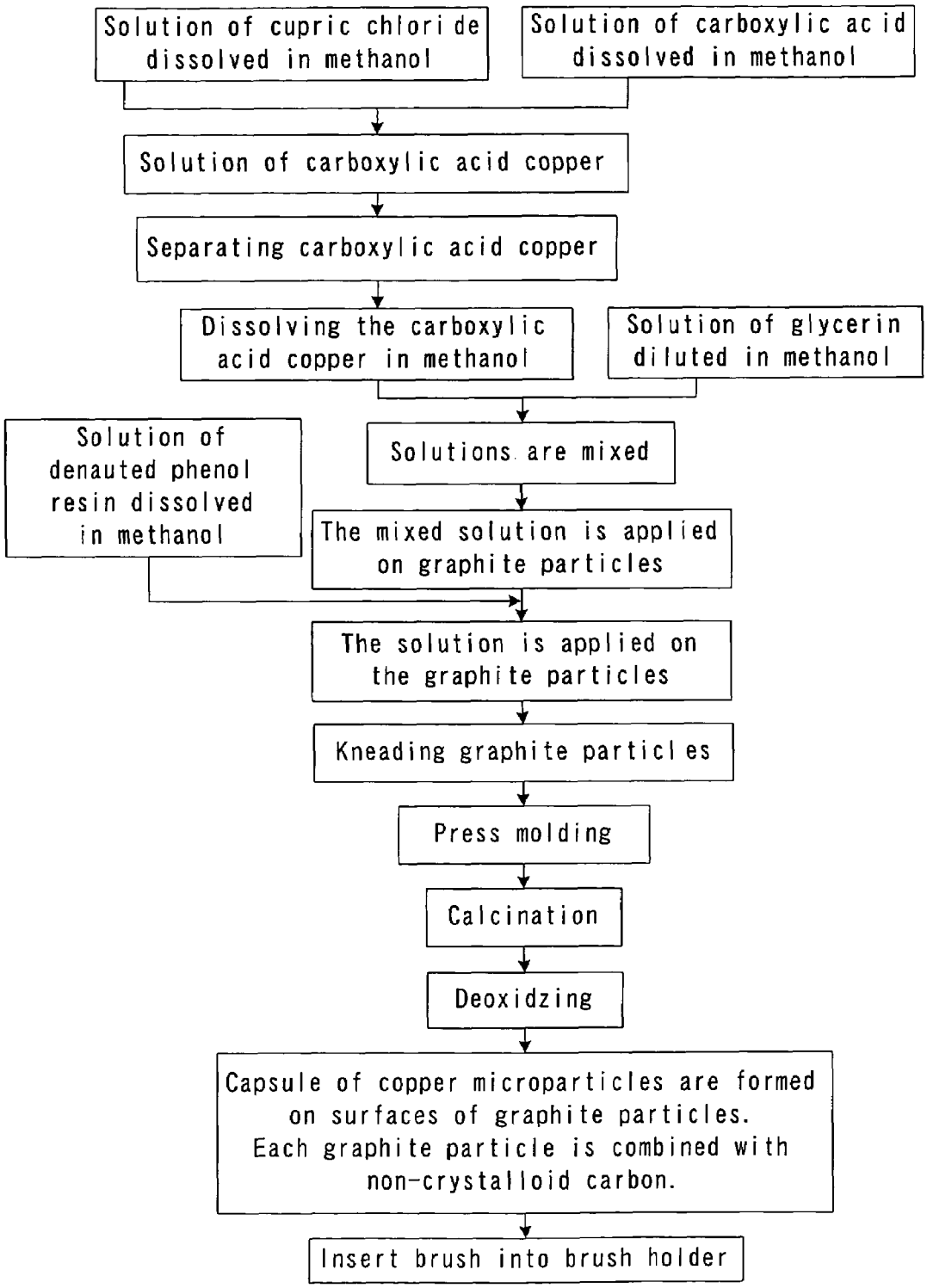
FIG. 2 illustrates a diagram of another process for forming copper microparticles on a graphite particle.

As shown in FIG. 1, the denatured phenol resin is used as a binder to fix the coating film on the graphite particle, however, the glycerin or the glycerin derivative, especially the diglycerin, can be used as a binder as shown in FIG. 2. Then, the calcinating process when the coating film on the surface of the graphite particle is formed by the mixed solution of the methanol solution of the carboxylic acid copper and the methanol diluted solution of the glycerin or the diglycerin will be explained as follows. The copper atom comprising the carboxylic acid copper as one element of the coating film formed on the surface of the graphite particle is reacted with the oxygen atom of the carboxylic acid and precipitated as the microparticles of the copper oxide. The hydrogen atom and the oxygen atom comprising the carboxylic acid copper react each other to generate water, then the water evaporates into the air. Further, the carbon atom reacts with the oxygen atom to form the carbon dioxide. Then, the carbon dioxide evaporates into the air, and some carbon atoms are precipitated as a solid body of the non-crystalloid carbon. In addition, the methanol and the glycerin as solvents to prepare the solutions evaporate into the air when they are calcinated. The thermal decomposition of the glycerin starts at about 150° C., then perfectly decomposed into $CO_2$ and $H_2O$ at 250° C. The thermal decomposition of the diglycerin starts at about 250° C., then perfectly decomposed into $CO_2$ and $H_2O$ at 320° C. When the amount of the non-crystalloid carbon generated from the carbon atom of the carboxylic acid copper is greater than the amount of the copper oxide generated from the copper atom of the carboxylic acid copper of the non-crystalloid carbon, another resistance layer is formed by the non-crystalloid carbon because the resistivity of the non-crystalloid carbon is higher than the resistivity of the graphite particle, as a result, the electric resistance of the whole brush is increased. Such phenomenon is not preferable. When the glycerin is the glycerin derivative is used as a binder, non-crystalloid carbon is not practically calcinated unlike the aforementioned case related to the carbonization of the denatured phenol resin. Thus, the density of the copper microparticles precipitated on the surface of the graphite particle can be increased. When the glycerin is used as a binder, the molded body can be deoxidized under the hydrogen including atmosphere after its calcinating process. The hydrogen including atmosphere can be a deoxidizing atmosphere being equal to or more than 50 Vol % of the nitrogen gas and equal to or less than 50 Vol % of the hydrogen gas, especially the being equal to or more than 92 Vol % of the nitrogen gas and equal to or less than 8 Vol % of the hydrogen gas. Then, the denatured phenol resin solution is applied to the graphite particle.

When the glycerin is used as a binder, the calcination temperature can be equal to or less than 500° C., especially, equal to or more than 300° C. and equal to or less than 400° C. The calcinate time may be varying depending on the calcination temperature. The time can be 10-40 minutes, especially, 20 minutes-1 hour.

Generally, the metal graphite brush is mechanically worn due to a friction between the commutator and the brush which is sliding on the commutator. In addition, the metal graphite brush can be worn due to an electric change such as spark discharge. Both known arts are not focusing on the spark discharge which causes the wear of the brush. Specifically, in both known arts, a method to improve the life of the brush by decreasing the spark discharge energy in the metal graphite brush is not disclosed. Actually, the metal graphite brush made of the collectivity of the graphite particles where electric field silver powders are approximately evenly dispersed is worn due to the spark discharge which occurs in the graphite particle. Specifically, the spark discharge is generated when a predetermined electrical pressure is applied to the brush, and the brush is disengaged from the commutator. Although the brush is normally used, such phenomenon naturally occurs.

According to the current invention, the copper microparticles is precipitated on the surface of the praphite particle at the high density as described above. Then, the clusters of the continuing particle comprising the conductive path of the copper microparticles are formed on the surface of the graphite particle. As a result, charge travels along the arbitrary path on the surface of the copper microparticles of the graphite particle, then the charge is emitted from an arbitrary point. Thus, induced charge travels on the path of the continuing copper particle, then countless numbers of cores of discharges at which the charge is discharged is formed. As a result, damages due to spark discharge can be eased, at the same time, noise level at the discharge can be decreased.

EMBODIMENT

Preferred embodiments according to the current invention will be explained as follows. First, an embodiment for generating the carboxylic acid copper will be explained, especially, an embodiment to generate the carboxylic acid copper using the methanol solution having high solubility relative to the alcohol group will be explained. It is preferable to use the carboxylic acid copper of higher solubility for precipitating the copper oxide particle or the copper particle by heat-treating at high density.

In an embodiment 1, butanoic acid is used as carboxylic acid. A methanol solution of the butanoic acid is prepared as follows. First, 1000 g butanoic acid relative to the methanol 100 g is weighed, then the acid is mixed into a container in which the methanol 100 g at 20° C. is filled and agitated by the magnetic stirrer. Thus, the methanol solution of the butanoic acid (carboxylic acid copper) having the aforementioned solubility is prepared.

Next, a methanol solution of the copper chloride is prepared as follows. First, 20 g copper chloride relative to the methanol 100 g is weighed, then the copper chloride is mixed into a container in which the methanol 100 g at 20° C. is filled and agitated by the magnetic stirrer. Thus, the methanol solution of the copper chloride having the aforementioned solubility is prepared.

Finally, the methanol solution of the butanoic acid and the methanol solution of the copper chloride are mixed to generate the butanoic acid copper. The methanol solution of the butanoic acid and the methanol solution of the copper chloride are weighed to be 2:1 of mole ratio of butanoic acid: copper chloride. These solutions are mixed in the container to generate the butanoic acid copper (carboxylic acid copper).

In an embodiment 2, acrylic acid is used as carboxylic acid. A methanol solution of the acrylic acids is prepared as follows. First, 1000 g acrylic acids relative to the methanol 100 g is weighed, then the acid is mixed into a container in which the methanol 100 g at 20° C. is filled and agitated by the magnetic stirrer. Thus, the methanol solution of the acrylic acids (carboxylic acid copper) having the aforementioned solubility is prepared.

Next, a methanol solution of the copper chloride is prepared as same as the embodiment 1. First, 20 g copper chloride relative to the methanol 100 g is weighed, then the copper chloride is mixed into a container in which the methanol 100 g at 20° C. is filled and agitated by the magnetic stirrer. Thus, the methanol solution of the cupric chloride having the aforementioned solubility is prepared.

Finally, the methanol solution of the acrylic acids and the methanol solution of the cupric chloride are mixed to generate the acrylic acids copper. The methanol solution of the acrylic acids and the methanol solution of the cupric chloride are weighed to be 2:1 of mole ratio of acrylic acids:cupric chloride. These solutions are mixed in the container to generate the acrylic acids copper (carboxylic acid copper).

In an embodiment 3, octanoic acid is used as carboxylic acid. A methanol solution of the octanoic acid is prepared as follows. First, 500 g octanoic acid relative to the methanol 100 g is weighed, then the acid is mixed into a container in which the methanol 100 g at 20° C. is filled and agitated by the magnetic stirrer. Thus, the methanol solution of octanoic acid (carboxylic acid copper) having the aforementioned solubility is prepared.

Next, a methanol solution of the copper chloride is prepared as follows. First, 20 g copper chloride relative to the methanol 100 g is weighed, then the copper chloride is mixed into a container in which the methanol 100 g at 20° C. is filled and agitated by the magnetic stirrer. Thus, the methanol solution of the copper chloride having the aforementioned solubility is prepared.

Finally, the methanol solution of the octanoic acid and the methanol solution of the copper chloride are mixed to generate the octanoic acid copper. The methanol solution of the octanoic acid copper and the methanol solution of the copper chloride are weighed to be 2:1 of mole ratio of octanoic acid:copper chloride. These solutions are mixed in the container to generate the octanoic acid copper (carboxylic acid copper).

In each embodiment, the copper chloride reacts with the carboxylic acid to generate hydrochloric acid and the carboxylic acid copper, and the carboxylic acid copper is extracted from the methanol solution of the carboxylic acid copper. The carboxylic acid copper is weighed to be 1:1 of the weigh ratio of carboxylic acid copper:methanol, and the carboxylic acid copper is dissolved in the methanol as an organic solvent. Thus, the methanol solution of the carboxylic acid copper is prepared.

Then, two methods to form the coating film of the carboxylic acid copper solution on the surface of the graphite particle will be explained as follows. In one method, a solution of the denatured phenol resin is used as a binder. In the other method, an all-purpose organic solvent (e.g. glycerin) having a predetermined viscosity for functioning as only a binder is used, which generates no carbon upon the calcination.

First, an embodiment in which the solution of the denatured phenol resin (binder solution) is used as a binder. The reason why the denatured phenol resin is used is as follows. The denatured phenol resin is used as a binder being carbonized in later calcinate process because less carbon residue content (non-crystalloid carbon) is generated comparing to the carbon residue content generated from the native phenol resin. Specifically, the denatured phenol resin has an inclination to be thermally decomposed, to be dissolved in the methanol at arbitrary ratio, and to increase a percentage of the copper microparticles on the surface of the graphite particle. The melamine denatured phenol resin is applied as the denatured phenol resin.

It is preferable to use the methanol solution for the solvent of the denatured phenol resin because the methanol solution has a property being compatible with the carboxylic acid copper solution. Melamine denatured phenol resin powders are used in the embodiment. Melamine denatured phenol resin powder is dissolved in the methanol to be 10 centipoises of viscosity at room temperature, then the methanol solution (binder solution) of the denatured phenol resin including 30 wt % nonvolatile matter is prepared Then, the methanol solution of the carboxylic acid copper is mixed with the solution of the denatured phenol resin (binder solution). In this case, the solution of the butanoic acid copper according to the embodiment 1 is mixed with the solution of the denatured phenol resin (binder solution) at volume ratio 10:1, wherein 1 means the ratio of the solution of the denatured phenol resin. The solution of the acrylic acid copper according to the embodiment 2 is also mixed with the solution of the denatured phenol resin (binder solution) at volume ratio 10:1, wherein 1 means the ratio of the solution of the denatured phenol resin. The percentage of the methanol solution of the carboxylic acid copper is increased, and the percentage of the methanol solution of the carboxylic acid copper is decreased to prevent the generation of the excess non-crystalloid carbon in the next calcinating process.

In such configuration, the graphite particles are dipped into the mixed solution at aforementioned ratio 10:1, and a thin coating film (approximately 1 μm) of the mixed solution is formed on the surface of the graphite particle. Denatured phenol resin functions as a binder for fixing the coating film on the surface of the graphite particle. In the embodiment 3, the solution of the octanoic acid copper is mixed with the methanol solution of the denatured phenol resin at volume ratio 5:1, wherein 1 means the methanol solution of the denatured phenol resin.

In such configuration, the graphite particle is dipped into the mixed solution of the solution of the carboxylic acid copper and the methanol solution of the denatured phenol resin, and a thin coating film (approximately 1 μm) of the mixed solution is formed on the surface of the graphite particle.

Glycerin of trivalent alcohol can be used as a binder of the aforementioned multi-purpose organic solvent having a moderate viscosity. Glycerin can function as a binder to form the coating film of the carboxylic acid copper on the surface of the graphite particle. Glycerin is thermally decomposed at 250° C. and completely evaporates into the air. Glycerin whose viscosity of the glycerin is 1500 centipoises at 20° C. is diluted with the methanol to be 10 centipoises at 20° C.

Then, the solution of the carboxylic acid copper dissolved in the methanol and the diluted solution of the glycerin diluted with methanol are mixed. In this case, the solution of the butanoic acid copper according to the embodiment 1 is mixed with the diluted solution of the glycerin diluted with methanol at volume ratio 5:1, wherein 1 means the ratio of the diluted solution of the glycerin. The solution of the acrylic acid copper according to the embodiment 2 is also mixed with the diluted solution of the glycerin diluted with methanol at volume ratio 5:1, wherein 1 means the ratio of the diluted solution of the glycerin. When the graphite particles are dipped in such mixed solutions, the coating film of the mixed solution is preferably formed on the surface of the graphite particle at a necessary thickness (approximately 1 μm). In the embodiment 3, the solution of the octanoic acid copper is mixed with the diluted solution of the glycerin diluted with methanol at volume ratio 2.5:1, wherein 1 means the diluted solution of the glycerin diluted with methanol.

In such configuration, the graphite particles are dipped into the mixed solution of the solution of the carboxylic acid copper and the diluted solution of the glycerin diluted with methanol, and the coating film of the necessary thin (approximately 1 μm) is formed on the surface of the graphite particle.

Next, the graphite particles including the coating films are formed are kneaded, then a collectivity of the graphite particles fills a container being box shape, then a predetermined pressure (100 Pa) is applied to the container to make a compressed molded body of the graphite particles being cuboid shape.

Then, such compressed molded body is calcinated under the oxygen including atmosphere. A preferable product generated by the calcinate process will be explained first, then the calcinating condition to generate such preferable product will be explained. First, the product generated by calcinating the molded body including the graphite particles having the coating films of the solution where the solution of the carboxylic acid copper dissolved in the methanol is mixed with the solution of the denatured phenol resin dissolved in the methanol is formed The copper atom is decomposed from the carboxylic acid copper when the carboxylic acid copper is calcinated, then copper atom being copper molecule is precipitated as microparticles of the copper oxide on the surface of the graphite particle. Then, the hydrogen atom of the carboxylic acid copper reacts with the oxygen atom of the carboxylic acid copper to become water when the molded body is calcinated, then the water evaporates into the air. Furthermore, the carbon atom becomes the carbon and evaporates into the air when the molded body is calcinated.

When the denatured phenol resin which is another element of the coating film formed on the surface of the graphite particle is calcinated, and some carbon atom is precipitated as solid material of the non-crystalloid carbon, the other carbon atom becomes carbon dioxide and evaporates. In addition, the hydrogen atom reacts with the oxygen atom to become water due to the calcination, then the water evaporates into the air. Further, the methanol of each solution evaporates into the air when the mold body is calcinated.

When the amount of the non-crystalloid carbon generated from the carbon atom of the carboxylic acid copper and the denatured phenol resin is greater than the amount of the copper oxide generated from the copper atom of the carboxylic acid copper, the conduct path of the continuing copper particle is interrupted by the carbons inserted among the clusters of the copper particles, and the resistance of the whole brush is increased because a new resistance layer of the non-crystalloid carbon is formed due to the resistivity of the non-crystalloid carbon being higher than the resistivity of the graphite particle. Such configuration is not preferable. It is preferable that the volume percentage of the copper oxide particle is equal to or more than 90% relative to the all precipitated solid material, and the volume percentage of the non-crystalloid carbon is equal to or less than 10% relative to the all precipitated solid material.

The carboxylic acid copper can be thermally decomposed with ease at 150° C. It is preferable that much of carbon atoms of the denatured phenol resin become carbon dioxide and evaporate into the air. To obtain such products, the molded body should be calcinated under the atmospheric environment. In addition, it is preferable that all hydrogen atom of the carboxylic acid copper and all hydrogen atom of the denatured phenol resin react with oxygen to become water, then the water evaporates into the air. Thus, the molded body should be calcinated under the atmospheric environment as aforementioned above. Further, it is preferable that the oxygen atom of the carboxylic acid copper is used for oxidizing the copper atom of the carboxylic acid copper precipitated as copper particles to become the copper oxide. Thus, the molded body should be calcinated under the atmospheric environment as aforementioned above.

Next, the temperature of the calcinations will be explained as follows. When the carboxylic acid copper is calcinated under the atmospheric environment, the precipitated copper particle grows under the calcination temperature, so that the size of the copper oxide particle is changed. According to the embodiments of the current invention, the copper microparticles precipitated on the surface of the graphite particle are electrically contacted each other at at least one portion thereof.

Thus, the charge conductive path of the copper microparticles is formed on the surface of the graphite particle. On this account, it is preferable that the small copper oxide microparticles are precipitated at high density. Thus, the calcination temperature is set at between equal to or more than 300° C. and equal to or less than 500° C., especially, the calcination temperature is set at 450° C. The calcinations time is 2 hours. As aforementioned above, after the molded body is calcinated under the atmospheric environment, the molded body is heated under the copper oxide microparticles of the molded body deoxidizing atmosphere, then the copper oxide microparticles of the molded body are deoxidized in the copper microparticles. Through such process, the clusters of the copper microparticles at 10-50 nanometer can be precipitated on the surface of the graphite particle, the density of the precipitated copper microparticles can be increased, the contactability of each copper microparticles can be increased, as a result, a preferable continuing charge conductive path can be formed. The deoxidizing atmosphere includes 95 Vol % nitrogen gas and 5 Vol % hydrogen gas. The deoxidizing temperature can be lower than the aforementioned calcination temperature. In the embodiments, the deoxidizing temperature is set at 300° C. The deoxidizing time can be smaller than the aforementioned calcination time. In the embodiments, the deoxidizing time is 1 hour.

As aforementioned above, in the embodiment where the coating film is formed on the graphite particle by using the mixed solution of the solution of the carboxylic acid copper dissolved in the methanol and the solution of the denatured phenol resin dissolved in the methanol, the molded body is calcinated at between equal to or more than 300° C. and equal to or less than 500° C., deoxidized under the deoxidizing atmosphere including the hydrogen gas, the multiple clusters of the copper microparticles are precipitated on the surface of the graphite particle, and the clusters electrically contact each other. In this way, the charge conductive path of the copper microparticles is formed.

Next, the embodiment where the coating film of the mixed solution of the solution of the carboxylic acid copper dissolved in the methanol and the solution of the glycerin diluted in the methanol is formed on the surface of the graphite particle will be further explained in detail. The copper atom of the carboxylic acid copper being a component of the coating film formed on the surface of the graphite particle is reacted with the oxygen atom of the carboxylic acid to precipitate the copper oxide microparticles when the molded body is calcinated. The hydrogen atom of the carboxylic acid copper reacts with the oxygen atom of the carboxylic acid copper to become water, the water evaporates into the air. Further, the carbon atom reacts with the oxygen atom to become the carbon dioxide when the molded body is calcinated, then the carbon dioxide evaporate into the air, and some carbon atoms become the non-crystalloid carbon. In addition, the methanol and the glycerin as a solvent are decomposed into $CO_2$ and $H_2O$ when the molded body is calcinated, and the $CO_2$ and $H_2O$ evaporates into the air. When the amount of the non-crystalloid carbon generated from the carbon atom of the carboxylic acid copper is greater than the amount of the copper oxide generated from the copper atom of the carboxylic acid copper, the conduct path of the continuing copper particle is interrupted by the non-crystalloid carbon particle inserted among the clusters of the copper particles, and the resistance of the whole brush is increased because a new electric resistance layer of the non-crystalloid carbon is formed due to the resistivity of the non-crystalloid carbon being higher than the resistivity of the graphite particle. Such configuration is not preferable. When the glycerin is used as a binder, the amount of the precipitated non-crystalloid carbon is small because the glycerin functions as only a binder unlike the case the denatured phenol resin which is carbonized is used as a binder. Thus, when the glycerin is used as a binder to form the coating film from the solution of the denatured phenol resin dissolved in the methanol after the coating film of the solution of the carboxylic acid copper and the glycerin diluted with methanol is formed on the surface of the graphite particle, the molded body is calcinated under the deoxidizing atmosphere including 92 Vol % nitrogen gas and 8 Vol % hydrogen gas.

The calcination temperature when the glycerin is used as a binder is set at between equal to or more than 300° C. and the equal to or less than 500° C., especially, set at 450° C., and the calcinating time is 2 hours.

As aforementioned above, in the embodiment where the coating film is formed on the graphite particle by using the mixed solution of the solution of the carboxylic acid copper dissolved in the methanol and the solution of the glycerin diluted in the methanol, the molded body is calcinated at equal to or less than 500° C. under the deoxidizing atmosphere including the hydrogen gas, the multiple clusters of the copper microparticles are precipitated on the surface of the graphite particle, and the clusters electrically contact each other. In this way, the charge conductive path of the copper microparticles is formed According to the current invention, nanometer-level copper microparticles being electrically contacted each other at at least one portion thereof are generated on the surface of the graphite particle of the metal graphite material. If a motor is made of metal graphite material having such configuration, damage due to spark discharge can be prevent. Furthermore, using such material for the motor, an electrical energy of the spark discharge can be reduced, so that the level of an electrical noise generated upon the spark discharge can be lowered The principles, preferred embodiment and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

I claim:

1. Metal graphite material including a molded body having a collectivity of graphite particles and copper particles comprising:

graphite and copper as main elements;

copper particles including copper microparticles whose average diameter is between 5 and 100 nm, and a cluster of the copper microparticles fixed on a surface of the graphite particle to form a conductive path of the contacting copper microparticles on the surface of the graphite particle, wherein a charge induced from the graphite particle is conducted, and wherein the copper microparticles are fixed on the surface of the graphite particle with a binder of non-crystalloid carbon.

2. Metal graphite material according to claim 1, wherein the metal graphite material is used for a motor brush.

* * * * *